US011273564B2

(12) United States Patent
Park et al.

(10) Patent No.: US 11,273,564 B2
(45) Date of Patent: Mar. 15, 2022

(54) RAZOR ASSEMBLY

(71) Applicant: DORCO CO., LTD., Seoul (KR)

(72) Inventors: Young Ho Park, Seoul (KR); Jae Joon Lee, Seoul (KR); Sung Hee Son, Seoul (KR); Shin Hwan Park, Seoul (KR); Sang Hun Park, Seoul (KR)

(73) Assignee: DORCO CO., LTD., Seoul (KR)

( * ) Notice: Subject to any disclaimer, the term of this patent is extended or adjusted under 35 U.S.C. 154(b) by 0 days.

(21) Appl. No.: 16/848,726

(22) Filed: Apr. 14, 2020

(65) Prior Publication Data

US 2020/0346358 A1 Nov. 5, 2020

(30) Foreign Application Priority Data

Apr. 30, 2019 (KR) ..... 10-2019-050374

(51) Int. Cl.
*B26B 21/40* (2006.01)
*B26B 21/52* (2006.01)
*B26B 21/44* (2006.01)

(52) U.S. Cl.
CPC ..... *B26B 21/405* (2013.01); *B26B 21/521* (2013.01); *B26B 21/4018* (2013.01); *B26B 21/4031* (2013.01); *B26B 21/443* (2013.01)

(58) Field of Classification Search
CPC . B26B 21/405; B26B 21/521; B26B 21/4018; B26B 21/4031; B26B 21/443
USPC ..... 30/42–46
See application file for complete search history.

(56) References Cited

U.S. PATENT DOCUMENTS

| | | | |
|---|---|---|---|
| 5,687,485 | A | 11/1997 | Shurtleff et al. |
| 5,761,814 | A | 6/1998 | Anderson et al. |
| 5,956,848 | A | 9/1999 | Tseng et al. |
| 5,956,851 | A | 9/1999 | Apprille et al. |
| 6,041,926 | A | 3/2000 | Petricca et al. |
| 6,052,903 | A | 4/2000 | Metcalf et al. |
| 6,185,822 | B1 | 2/2001 | Tseng et al. |

(Continued)

FOREIGN PATENT DOCUMENTS

| | | |
|---|---|---|
| EP | 3542977 | 9/2019 |
| GB | 2419102 | 4/2006 |
| WO | 2016203326 | 12/2016 |

OTHER PUBLICATIONS

European Patent Office Application Serial No. 20171960.6, Search Report dated Sep. 18, 2020, 8 pages.

*Primary Examiner* — Omar Flores Sanchez
(74) *Attorney, Agent, or Firm* — Lee, Hong, Degerman, Kang & Waimey PC

(57) ABSTRACT

A razor assembly includes a guide housing; a drive receiving member disposed on one side of the guide housing and movable in a first direction with respect to the guide housing; a blade housing disposed on another side of the guide housing; at least one shaving blade disposed at the blade housing; a razor handle extending from the guide housing; and a drive transmission member configured to transmit a driving force to the drive receiving member. The blade housing is configured to be moved with respect to the guide housing in a second direction that is not parallel to the first direction in response to movement of the drive receiving member in the first direction. The drive receiving member is further configured to be moved in the first direction with respect to the guide housing by the driving force transmitted from the drive transmission member.

10 Claims, 18 Drawing Sheets

(56) References Cited

U.S. PATENT DOCUMENTS

| | | | | |
|---|---|---|---|---|
| 6,212,777 | B1 | 4/2001 | Gilder et al. | |
| 6,442,839 | B1 | 9/2002 | Tseng et al. | |
| 6,516,518 | B1 | 2/2003 | Garraway et al. | |
| 6,612,040 | B2 | 9/2003 | Gilder | |
| 6,684,513 | B1 | 2/2004 | Clipstone et al. | |
| 2007/0151106 | A1* | 7/2007 | Steunenberg | B26B 21/38 30/50 |
| 2008/0155831 | A1* | 7/2008 | Royle | B26B 21/38 30/34.1 |

* cited by examiner

PRIOR ART

PRIOR ART

RAZOR ASSEMBLY

CROSS-REFERENCE TO RELATED APPLICATIONS

Pursuant to 35 U.S.C. § 119(a), this application claims the benefit of earlier filing date and right of priority to Korean Patent Application Number 10-2019-0050374, filed on Apr. 30, 2019, the contents of which are herely incorporated by reference herein in its entirety.

TECHNICAL FIELD

The present disclosure relates to a razor assembly.

BACKGROUND

The statements in this section merely provide background information related to the present disclosure and do not necessarily constitute prior art.

Recent years saw a razor technique emerged for linearly moving the razor cartridge in the shaving direction, as a method for increasing the hair cutting efficiency of the shaving blade.

For example, Korean Registered Patent No. 10-1068271 (hereinafter referred to as patent document 1) discloses a razor cartridge for providing a reciprocating linear movement of a blade housing in a shaving direction by using an eccentric cam. However, the razor disclosed in patent document 1 has a shortcoming that the razor cartridge is fixed with respect to the razor handle, and cannot be pivoted.

As a solution to this, Korean Registered Patent No. 10-1774370 (hereinafter referred to as patent document 2) discloses a razor cartridge which provides a reciprocating linear movement of a blade housing by using an eccentric cam and at the same time, can be pivoted with respect to a razor handle (hereinafter, this razor cartridge is referred to as LM razor).

Specifically, as shown in FIG. 1 and FIG. 2, a conventional LM razor 10 has a drive receiving unit 12 and a transmission unit 13. The drive receiving unit 12 includes an upper wall 121 and a lower wall 123 which are disposed to face each other in the shaving direction. The transmission unit 13 includes an eccentric cam body 131 which rotates about a rotation axis MA, and an eccentric cam head 133 spaced apart from the rotation axis MA and accommodated between the upper wall 121 and the lower wall 123.

As the eccentric cam body 131 rotates about the rotation axis MA, the eccentric cam head 133 may depress the upper wall 121 and the lower wall 123 of the drive receiving unit 12, and thereby the drive receiving unit 12 may reciprocate linearly in the shaving direction.

With a blade housing 11 fixedly connected to the drive receiving unit 12, the blade housing 11 may also reciprocate linearly in the shaving direction.

Such reciprocal linear movement of the blade housing 11 may increase the hair cutting efficiency of a shaving blade (not shown) disposed in the blade housing 11.

However, the conventional LM razor 10 has an issue that the degree of linear movement of the blade housing 11 becomes different depending on the degree of pivoting of the razor cartridge 1.

Specifically, as shown in FIG. 1, where the shaving cartridge 1 is pivoted such that a shaving plane S and the rotation axis MA of the eccentric cam body 131 are perpendicular to each other, the blade housing 11 of the conventional LM razor 10 has a moving range of D1.

However, as shown in FIG. 2, where the shaving cartridge 1 is pivoted such that the shaving plane S and rotation axis MA of the eccentric cam body 131 form an acute angle $\phi$, the blade housing 11 of the conventional LM razor 10 has a moving range of D2 which is smaller than D1.

Therefore, the conventional LM razor 10 has a shortcoming that the degree of linear movement of the blade housing 11 depends on the degree to which the razor cartridge 1 is pivoted, resulting in inconsistent shaving performance during the use of the razor.

The conventional LM razor 10 has another issue that, when the razor cartridge 1 pivots, the side walls 121 and 123 of the drive receiving unit 12 interfere with the movement of the eccentric cam head 133, obstructing the control of the assembly tolerance between the side walls 121, 123 and the eccentric cam head 133.

Accordingly, the conventional LM razor 10 suffers from lost momentum when the rotational movement of the eccentric cam head 133 is converted to the linear movement of the blade housing 11, or suffers from noise occurring during the linear movement of the blade housing 11.

SUMMARY

In accordance with some embodiments, the present disclosure provides a razor assembly including a guide housing; a drive receiving member disposed on one side of the guide housing and configured to be movable in a first direction with respect to the guide housing; a blade housing disposed on another side of the guide housing; at least one shaving blade having a cutting edge and disposed at the blade housing; a razor handle extending from the guide housing; and a drive transmission member configured to transmit a driving force to the drive receiving member, at least a portion of the drive transmission member disposed on one side of the razor handle. The blade housing is configured to be moved with respect to the guide housing in a second direction that is not parallel to the first direction in response to movement of the drive receiving member in the first direction. The drive receiving member is further configured to be moved in the first direction with respect to the guide housing by the driving force transmitted from the drive transmission member.

DETAILED DESCRIPTION

Figure 1:
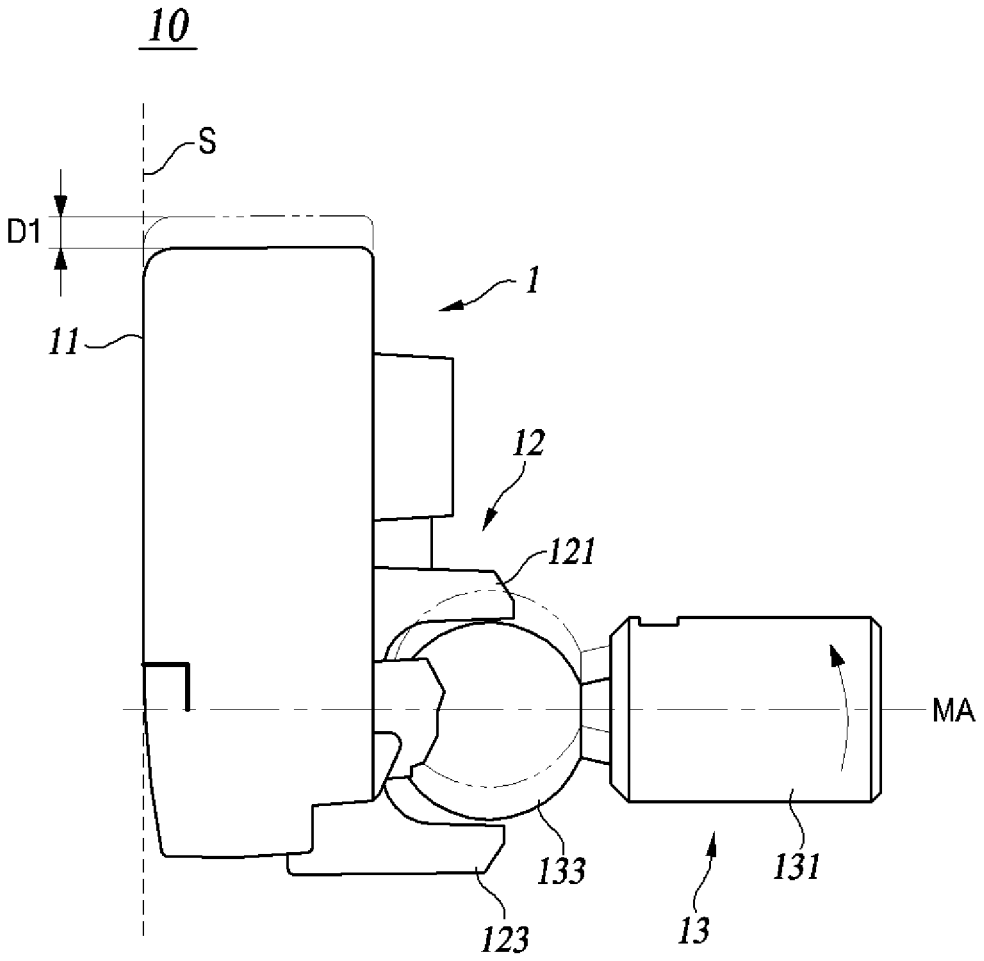
FIG. 1 is a diagram of a conventional LM razor operating with the shaving plane being pivoted perpendicularly to the rotation axis of the eccentric cam body.
Figure 2:
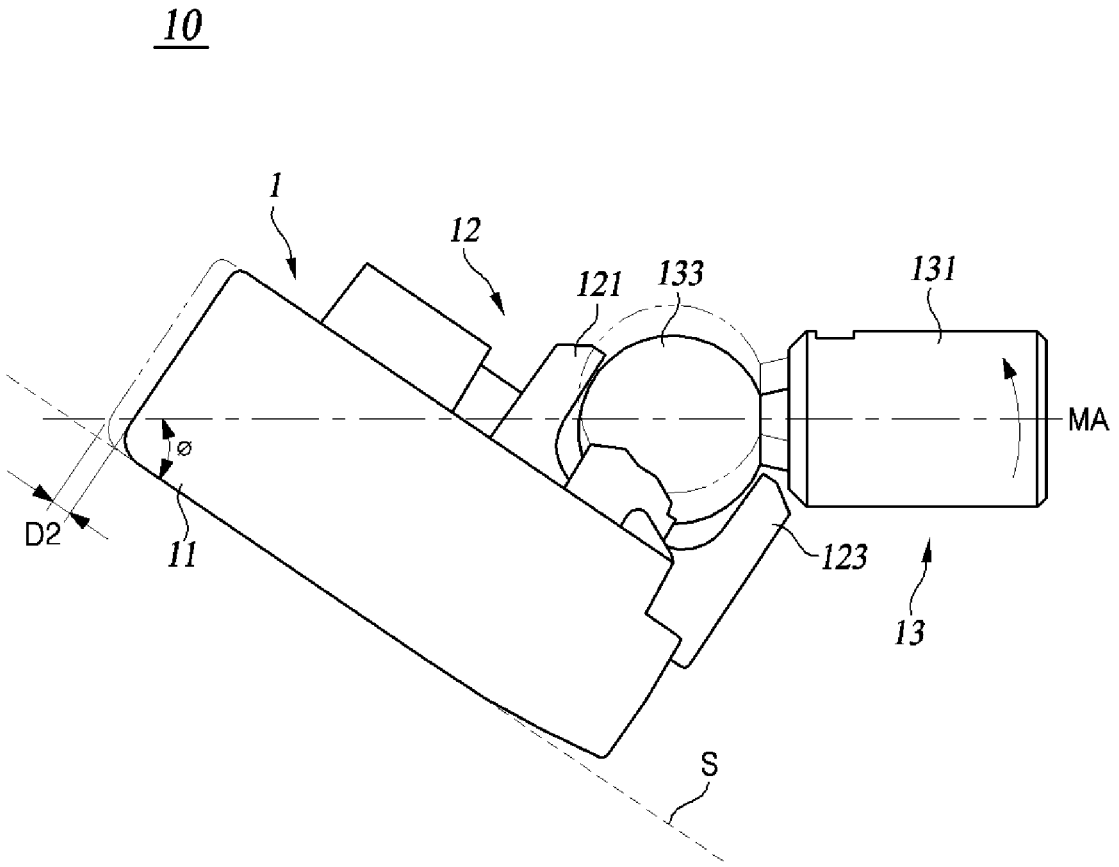
FIG. 2 is a diagram of a conventional LM razor operating with the shaving plane being pivoted at an acute angle to the rotation axis of the eccentric cam body.

The present disclosure thus aims at providing a razor assembly capable of maintaining a constant degree of linear motion of the blade housing, thereby providing an improved shave to the user, regardless of the degree of pivot of the razor cartridge.

In addition, the present disclosure seeks to provide a razor assembly that can minimize the issue of momentum loss and noise occurrence by easily controlling the assembly tolerance between the drive receiving member and the eccentric cam.

Hereinafter, some embodiments of the present disclosure will be described in detail with reference to the accompanying drawings. In the following description, like reference numerals designate like elements, although the elements are shown in different drawings. Further, in the following description of some embodiments, a detailed description of known functions and configurations incorporated therein will be omitted for the purpose of clarity and for brevity.

In describing the components of the embodiments according to the present disclosure, various terms such as first, second, i), ii), a), b), etc., may be used solely for the purpose of differentiating one component from the other, not to imply or suggest the substances, the order or sequence of the components. Throughout this specification, when a part "includes" or "comprises" a component, the part is meant to further include other components, not to exclude thereof unless specifically stated to the contrary.

Figure 3:
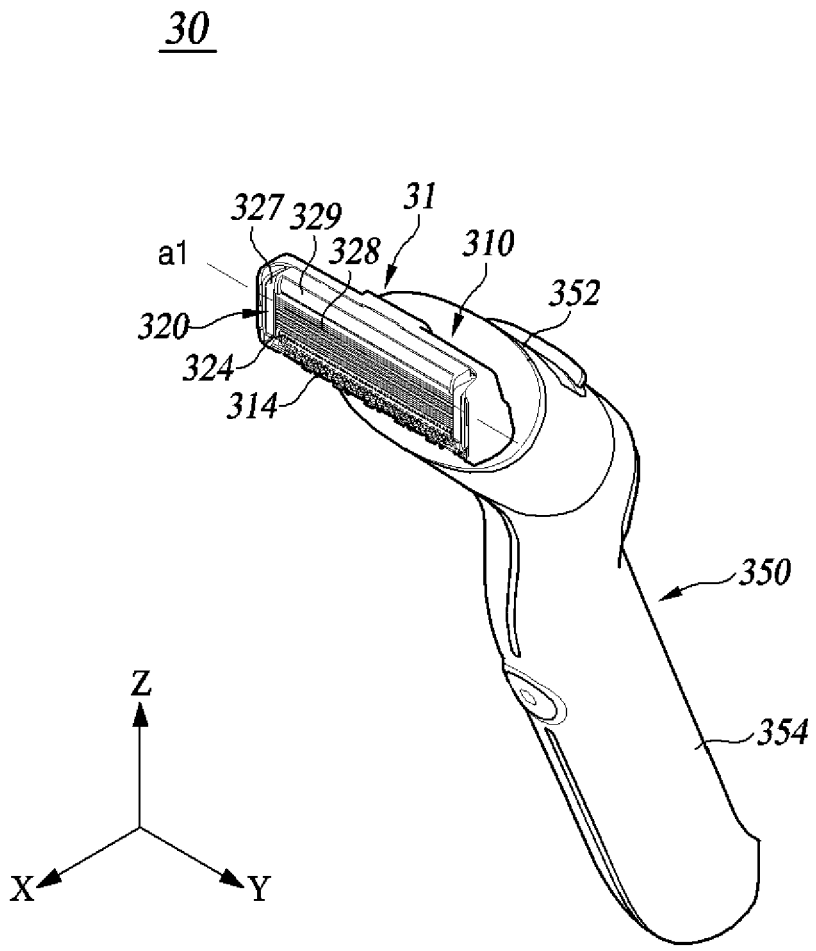
FIG. 3 is a front perspective view of a razor assembly according to at least one embodiment of the present disclosure.

FIG. 3 is a front perspective view of a razor assembly 30 according to at least one embodiment of the disclosure.

Figure 4:
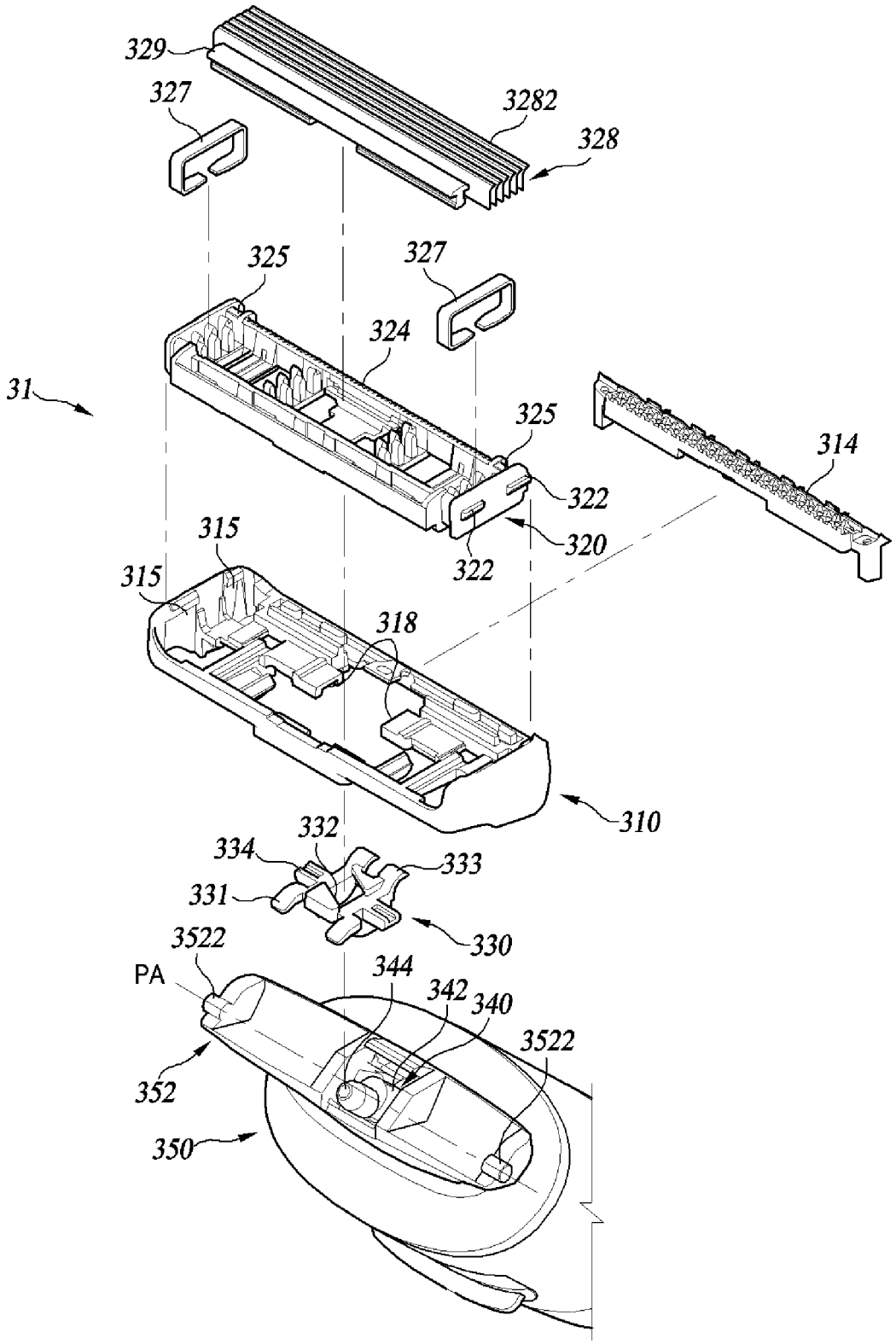
FIG. 4 is a front exploded perspective view of a razor assembly according to at least one embodiment of the present disclosure.

FIG. 4 is a front exploded perspective view of a razor assembly 30 according to at least one embodiment of the present disclosure.

As shown in FIG. 3 and FIG. 4, the razor assembly 30 may include a guide housing 310, a blade housing 320, a drive receiving member 330, a drive transmission member 340, and a razor handle 350.

The guide housing 310, the blade housing 320, and the drive receiving member 330 may constitute a razor cartridge 31 as a whole.

The guide housing 310 may function as the body of the razor cartridge 31 and may be a razor cartridge area that is coupled with the razor handle 350.

The guide housing 310 may house the blade housing 320 and the drive receiving member 330.

For example, the drive receiving member 330 may be disposed on one side of the guide housing 310, and the blade housing 320 may be disposed on the other side of the guide housing 310.

The guide housing 310 may include a guard member 314.

The guard member 314 may be disposed in front of or below at least one shaving blade 328 to stretch the user's skin prior to cutting the hair when the razor cartridge 31 moves in a shaving direction.

The guard member 314 may erect the hair in a direction perpendicular to the skin surface by stretching the user's skin, and thereby the at least one shaving blade 328 can cut the hair more easily.

The guard member 314 may define a shaving plane (S in FIG. 11) by contacting the skin.

In FIGS. 3 and 4, the guard member 314 is illustrated as being disposed in the guide housing 310, but the present disclosure is not limited thereto.

For example, the guard member 314 may be disposed on the blade housing 320.

The blade housing 320 may be an area on the razor cartridge 31 where hair cutting is performed.

The blade housing 320 may receive at least one shaving blade 328 with a cutting edge 3282 in the transverse direction a1.

Once accommodated in blade housing 320, the at least one shaving blade 328 may be supported by at least one clip 327.

A clip receiving groove 325 may be formed on the blade housing 320 to accommodate each clip 327.

The clip receiving groove 325 may be formed along a circumferential region of the blade housing 320, which is encircled by the clip 327.

The blade housing 320 may include a comb portion 324 and a lubricating strip 329.

The comb portion 324 may be disposed in front of or below the at least one shaving blade 328 and may include a plurality of protrusions spaced apart from each other in the transverse direction a1.

The comb unit 324 may collect the hairs into the spaces between the protrusions before cutting the hairs, and thereby allowing the hairs to be cut effectively by the shaving blades 328.

The lubrication strip 329 may apply a lubricating component to the user's skin after cutting of the hair, whereby the skin roughened by the cutting may be smoothed out.

In FIGS. 3 and 4, the comb portion 324 is shown disposed in front of or below the shaving blade 328, and the lubrication strip 329 is disposed behind or above the shaving blade 328, but the present disclosure is not limited thereto.

For example, the comb portion 324 and the lubrication strip 329 may be disposed opposite from each other based on the at least one shaving blade 328 or may be disposed at both sides of the at least one shaving blade 328.

Additionally, FIGS. 3 and 4 show the comb portion 324 and the lubrication strip 329 which are disposed on the blade housing 320, but the present disclosure is not limited thereto.

For example, the comb portion 324 and the lubrication strip 329 may be disposed on the guide housing 310 or may be disposed on both the guide housing 310 and the blade housing 320.

The drive receiving member 330 may transmit the driving force generated by the driving transmission unit 340 to the blade housing 320.

Figure 6:
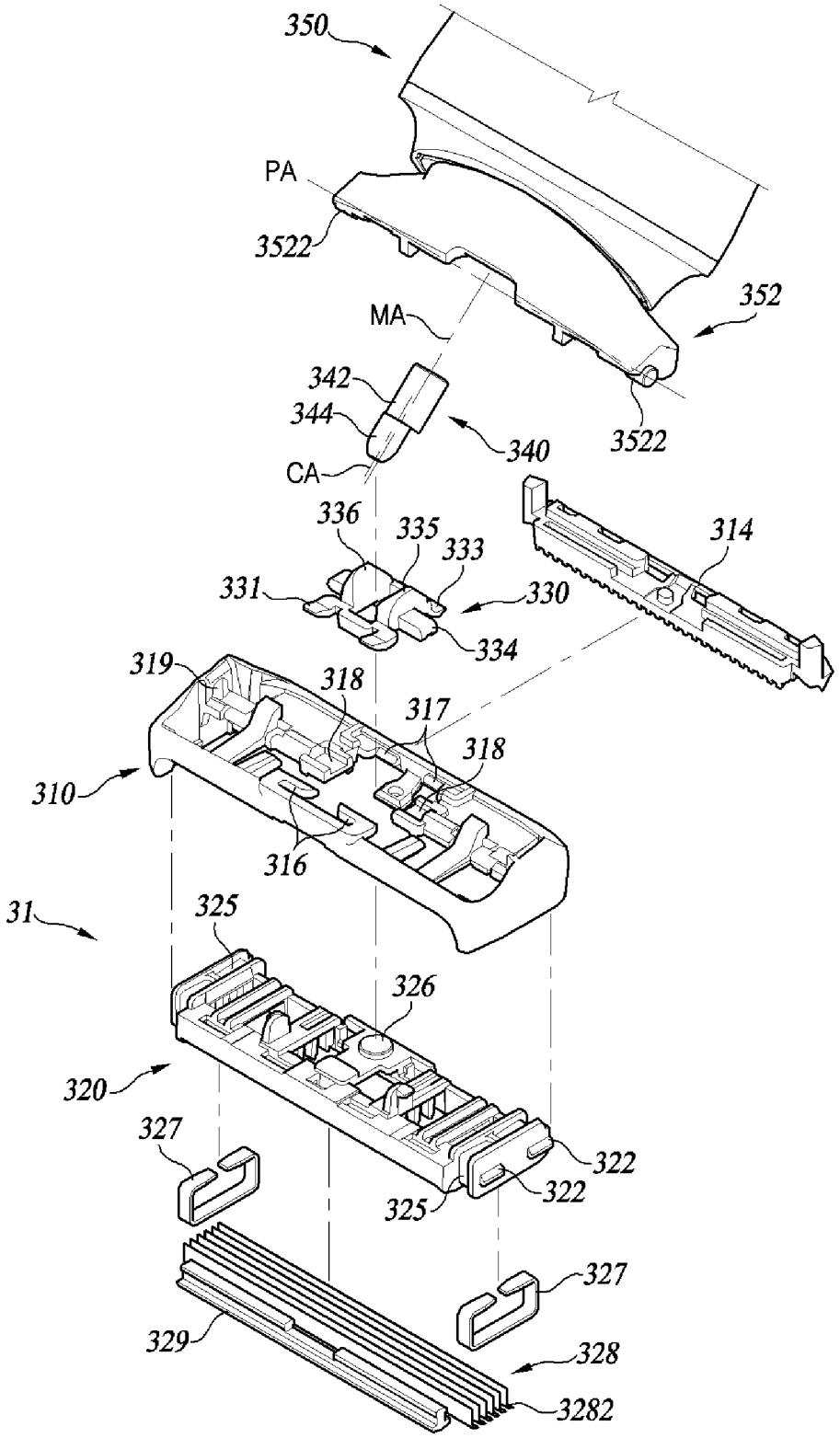
FIG. 6 is a rear exploded perspective view of a razor assembly according to at least one embodiment of the present disclosure.

The drive receiving member 330 may include a first direction-switching rail 332, while the blade housing 320 may include a first guided member 326 as shown in the rear view of FIG. 6.

The first guide member 326 may be inserted into the first direction-switching rail 332 and configured to move in the first direction-switching rail 332.

At least a portion of the first direction-switching rail 332 may include a region that is not parallel to the first direction.

For example, the first direction-switching rail 332 may define diagonal lines that are not parallel to the first direction, and the travel path of the first guide member 326 may have the corresponding diagonal path.

Here, the first direction refers to the direction of movement of the drive receiving member 330 relative to the guide housing 310.

The first direction may be parallel to the transverse direction a1 in which the blade housing 320 receives the at least one shaving blade 328, but the present disclosure is not limited thereto.

As shown in FIGS. 3 and 4, the drive transmission member 340 serves to provide a driving force to the drive receiving member 330 such that the latter may move in the first direction with respect to the guide housing 310. To this end, the drive transmission member 340 may utilize eccentric shaft rotation.

The razor handle 350 may extend from the guide housing 310 and may include a head portion 352 and a grip portion 354.

The head portion 352 on the razor handle 350 may be an area that is connected with the razor cartridge.

The head portion 352 may include bosses 3522 which may be fitted into boss holes 319 (shown in FIG. 6) formed in the guide housing 310.

This may form a pivot axis PA penetrating through the bosses 3522 and the boss holes 319 and parallel to the first direction.

The razor cartridge 31 may be configured to be pivotable about the pivot axis PA relative to the razor handle 350.

The grip portion 354 may extend from the head portion 352 to provide the user with a grippable area.

The razor handle 350 may be internally provided with a motor (not shown) for operating the drive transmission member 340 and a power supply device (not shown) for driving the motor.

Figure 5:
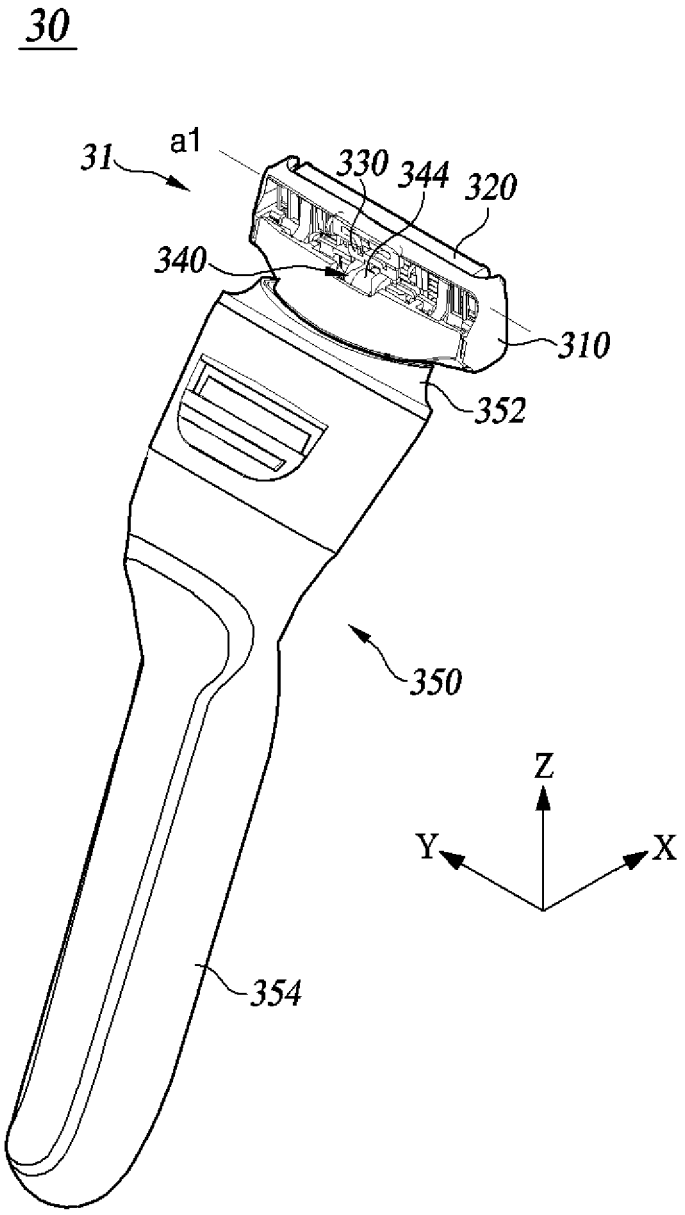
FIG. 5 is a rear perspective view of a razor assembly according to at least one embodiment of the present disclosure.

FIG. 5 is a rear perspective view of a razor assembly 30 according to at least one embodiment of the present disclosure.

FIG. 6 is a rear exploded perspective view of a razor assembly 30 according to at least one embodiment of the present disclosure.

As shown in FIGS. 5 and 6, the drive receiving member 330 has an upper protrusion 331 and a lower protrusion 333 which may be caught, respectively, in an upper jaw 316 and a lower jaw 317 which are formed on one side and the other side, respectively, of the guide housing 310, by which the drive receiving member 330 can be connected to the guide housing 310.

The upper jaw 316 and the lower jaw 317 may extend along the first direction, the upper protrusion 331 and the lower protrusion 333, which are caught in the respective jaws 316, 317, can move in the first direction.

Accordingly, the drive receiving member 330 may move in the first direction with respect to the guide housing 310 in a state of being connected to the guide housing 310.

The drive receiving member 330 has a stopping protrusion 334 accommodated in guide rails 318 formed at one side of the guide housing 310. The guide rails 318 may collectively have opposite end stoppers arranged in-line along the first direction.

The stopping protrusion 334 may contact the stopper of the guide rail 318 as the drive receiving member 330 moves in the first direction, whereby restricting the drive receiving member 330 from moving in the first direction.

The blade housing 320 may have side protrusions 322 which may be accommodated in guide grooves 315 formed on the other side of the guide housing 310, whereby connecting the blade housing 320 to the guide housing 310.

The guide grooves 315 may extend along the second direction, and the side protrusions 322, which are accommodated in the guide grooves 315, may move in the second direction along the guide grooves 315.

Accordingly, with respect to the guide housing 310, the blade housing 320 may move in the second direction while being connected to the guide housing 310.

The second direction is not parallel to the first direction and may be perpendicular to the transverse direction a1, i.e., parallel to the shaving direction of the at least one shaving blade 328.

In this case, the cutting edge 3282 of the at least one shaving blade 328 can make a linear motion parallel to the shaving direction with respect to the guide housing 310. The linear motion has the effect of improving the cutting force of the cutting edge 3282 when shaving.

In addition, the linear motion of the blade housing 320 may reduce the cutting surface of the hair by reducing the tugging caused by the at least one shaving blade 328 pulling the hair when cutting the hair, thereby enabling a clean shave.

The drive receiving member 330 may include a first side wall 335 and a second side wall 336.

The first side wall 335 and the second side wall 336 may be disposed to face each other in the first direction.

The drive transmission member 340 may include an eccentric cam body 342 and an eccentric cam head 344.

The eccentric cam body 342 may rotate about a rotation axis MA.

The eccentric cam head 344 may extend from the eccentric cam body 342 along a central axis CA and may be received between the first side wall 335 and the second side wall 336.

In FIG. 6, the center axis CA is illustrated to be spaced apart from the rotation axis MA, but the present disclosure is not limited thereto and they may be concentric in some cases.

The eccentric cam head 344 may be in contact with the first side wall 335 or the second side wall 336 as the eccentric cam body 342 rotates about the rotation axis MA, whereby depressing the drive receiving member 330 in the first direction.

The drive receiving member 330 depressed by the eccentric cam head 344 may be moved in the first direction with respect to the guide housing 310. Detailed description thereof is described in relation to FIG. 7A to FIG. 10B.

FIGS. 7A, 8A, 9A and 10A are rear views and FIGS. 7B, 8B, 9B and 10B are front views, illustrating sequential steps of operation of a razor assembly 30 according to at least one embodiment of the present disclosure.

Specifically, FIGS. 7A to 10B illustrate the eccentric cam head 344 when it is at 6 o'clock, 9 o'clock, 12 o'clock, and 3 o'clock positions with respect to the rotation axis MA of the eccentric cam body 342, respectively.

In FIGS. 7A to 10B, it is assumed that the eccentric cam body 342 rotates clockwise about the rotation axis MA when the razor cartridge 31 is viewed from the rear side.

In FIGS. 7A to 10B, it is assumed that the razor cartridge 31 is pivoted such that the shaving plane S and the rotational axis MA of the eccentric cam body 342 are perpendicular to each other.

FIGS. 7A, 8A, 9A and 10A show the blade housing 320 and the drive receiving member 330 as viewed from the rear of the razor cartridge 31, and FIGS. 7B, 8B, 9B and 10B show the guide housing 310 and the blade housing 320 as viewed from the front of the razor cartridge 31.

Figure 7A:
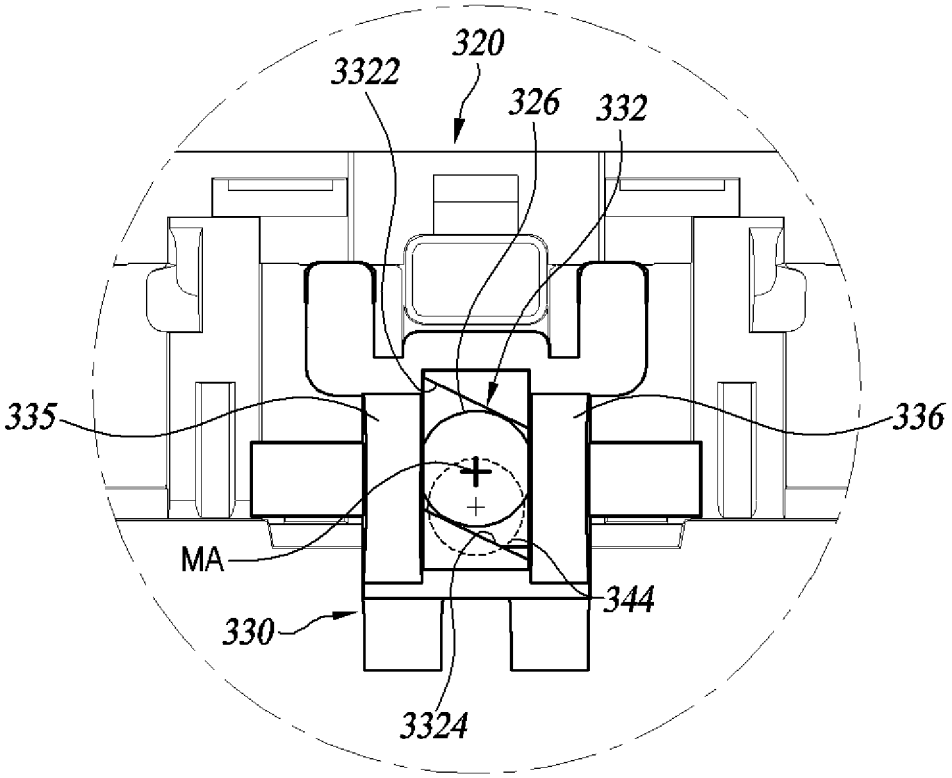
FIGS. 7A, 8A, 9A and 10A are rear views
Figure 7B:
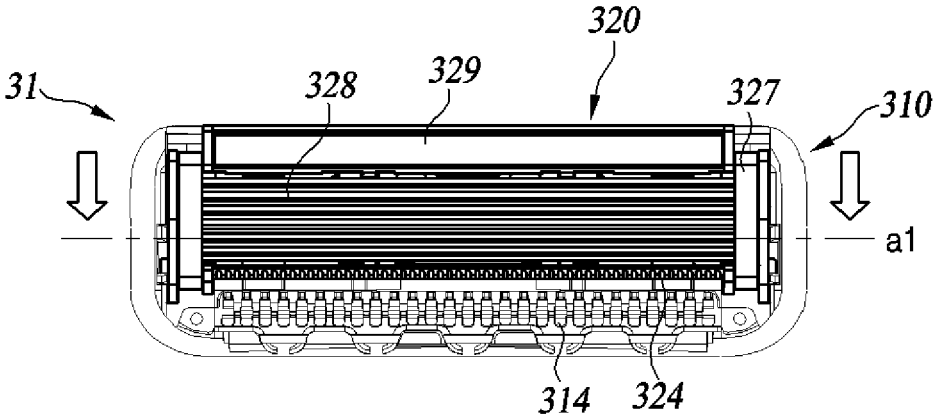
FIGS. 7B, 8B, 9B and 10B are front views illustrating sequential steps of operation of a razor assembly according to at least one embodiment of the present disclosure.

As shown in FIGS. 7A and 7B, the eccentric cam head 344 may be at the 6 o'clock position based on the rotation axis MA of the eccentric cam body 342.

The eccentric cam head 344 may contact the first side wall 335 of the drive receiving member 330 while moving from the 3 o'clock position to the 6 o'clock position, whereby depressing the first side wall 335.

The upper protrusion 331 and the lower protrusion 333 of the drive receiving member 330 are fixed to upper jaw 316 and the lower jaw 317 of the guide housing 310, respectively. The stopping protrusion 334 of the driving receiving portion 330 may be accommodated in the guide rails 318. Accordingly, the movement of the drive receiving member 330 relative to the guide housing 310 may be limited to the first direction.

Accordingly, when the eccentric cam head 344 depresses the first side wall 335, the drive receiving member 330 may move to the left side in the first direction with respect to the guide housing 310.

In particular, the drive receiving member 330 may move from a rightmost point to a middle point within the entire track segment of the drive receiving member 330.

As the drive receiving member 330 moves to the left side, an upper surface 3322 of the first direction-switching rail 332 may depress the first guide member 326.

With the side protrusions 322 of the blade housing 320 received in the guide grooves 315 of the guide housing 310, the movement of the blade housing 320 relative to the guide housing 310 may be limited to the second direction.

Therefore, when the upper surface 3322 of the first direction-switching rail 332 depresses the blade housing 320 by the first guide member 326, the blade housing 320 may be moved downward in the second direction with respect to the guide housing 310.

In particular, the blade housing 320 may move from an uppermost point to an intermediate point within the entire track segment of the blade housing 320.

Figure 8A:
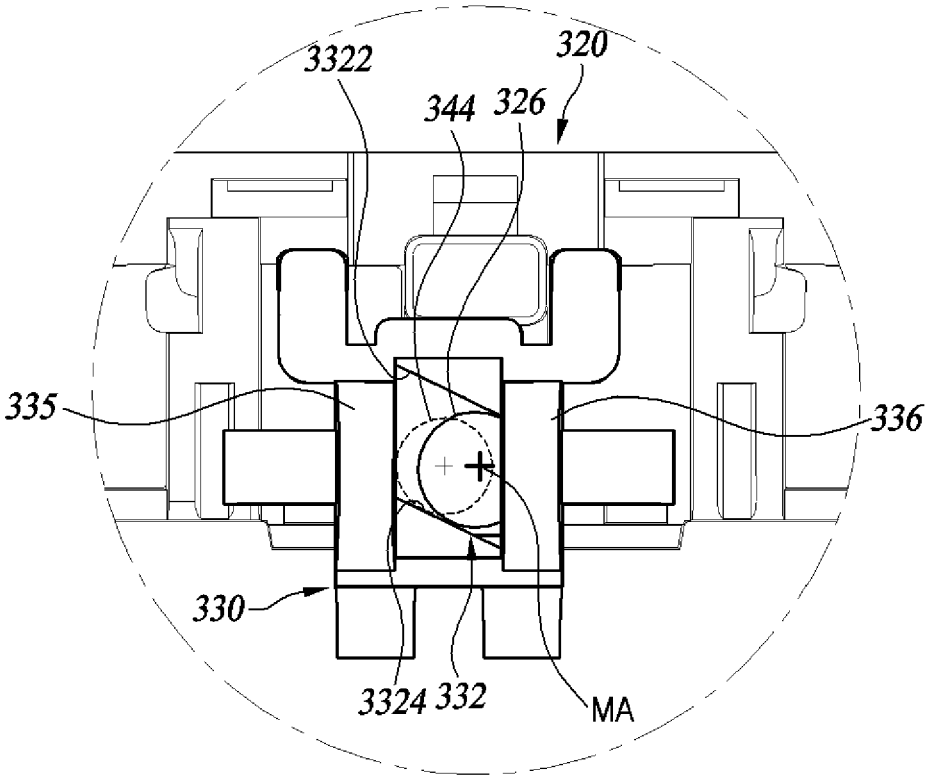
Figure 8B:
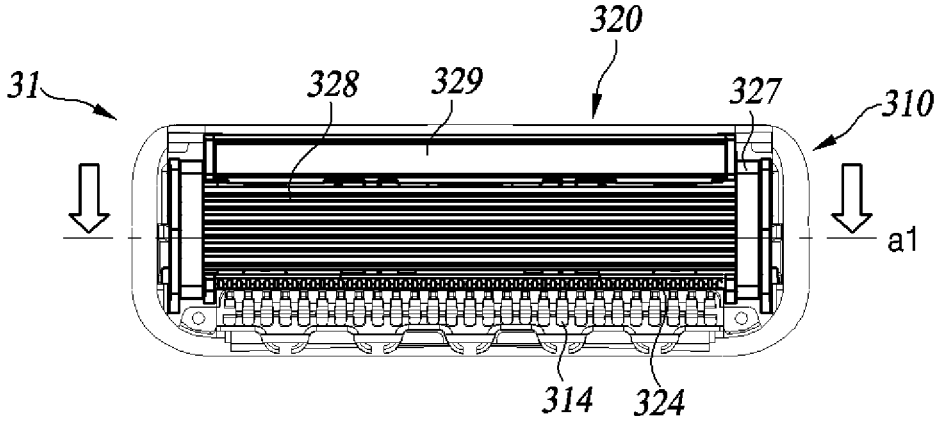

As shown in FIGS. 8A and 8B, the eccentric cam head 344 may be at the 9 o'clock position with respect to the rotation axis MA of the eccentric cam body 342.

The eccentric cam head 344 may contact the first side wall 335 of the drive receiving member 330 while moving from the 6 o'clock position to the 9 o'clock position, whereby depressing the first side wall 335.

Since the movement of the drive receiving member 330 relative to the guide housing 310 is limited to the first direction, depressing the first side wall 335 by the eccentric cam head 344 moves the drive receiving member 330 to the left with respect to the guide housing 310 in the first direction.

In particular, the driving receiving unit 330 may move from the middle point to the leftmost point within the entire track segment of the driving receiving unit 330.

As the drive receiving member 330 moves to the left side, the upper surface 3322 of the first direction-switching rail 332 may depress the first guide member 326.

Since the movement of the blade housing 320 relative to the guide housing 310 is limited to the second direction, depressing the first guide member 326 by the upper surface 3322 of the first direction-switching rail 332 allows the blade housing 320 to move downward in the second direction with respect to the guide housing 310.

In particular, the blade housing 320 may move from the middle point to a lowermost point within the entire track segment of the blade housing 320.

Figure 9A:
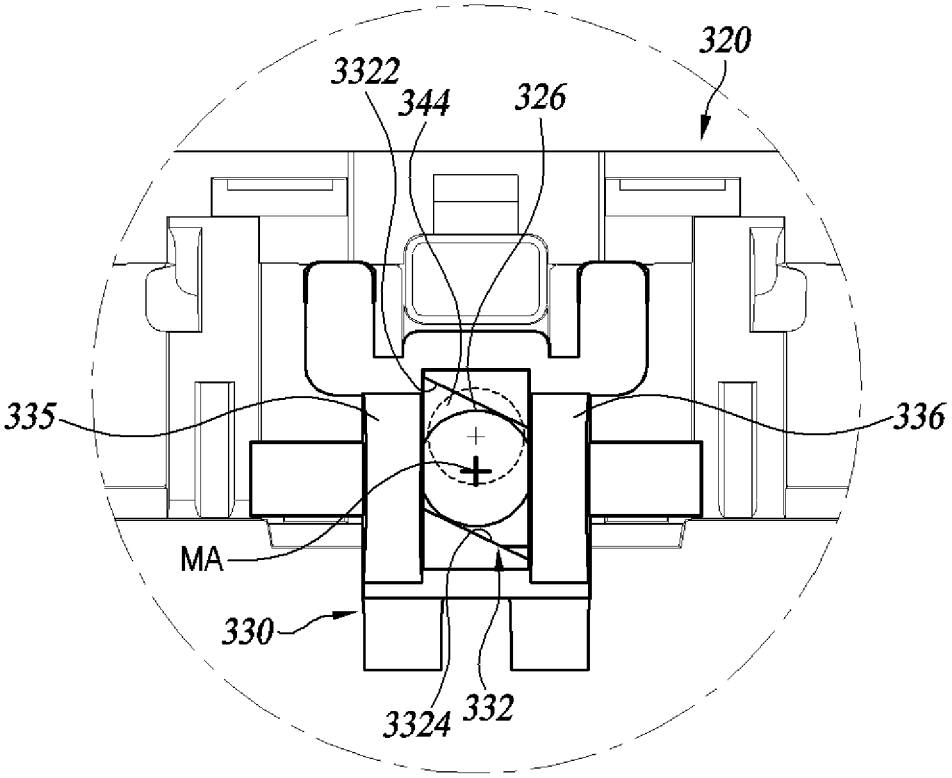
Figure 9B:
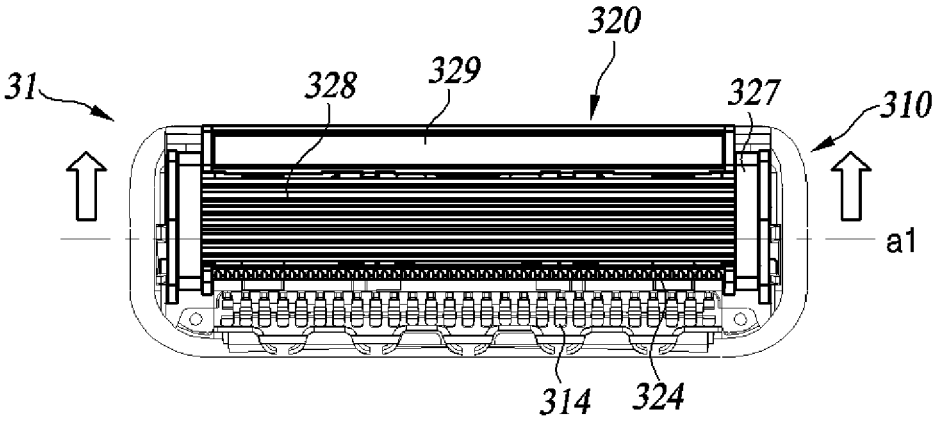

As shown in FIGS. 9A and 9B, the eccentric cam head 344 may be at the 12 o'clock position with respect to the rotation axis MA of the eccentric cam body 342.

The eccentric cam head 344 may contact the second side wall 336 of the drive receiving member 330 while moving from the 9 o'clock position to the 12 o'clock position, whereby depressing the second side wall 336.

Since the movement of the drive receiving member 330 relative to the guide housing 310 is limited to the first direction, depressing the second side wall 336 by the eccentric cam head 344 allows the drive receiving member 330 to move to the right in the first direction with respect to the guide housing 310.

In particular, the driving receiving unit 330 may move from the leftmost point to the middle point within the entire track segment of the driving receiving unit 330.

As the drive receiving member 330 moves to the right, the lower surface 3324 of the first direction-switching rail 332 may depress the first guide member 326.

Since the movement of the blade housing 320 relative to the guide housing 310 is limited to the second direction, depressing the first guide member 326 by the lower surface 3324 of the first direction-switching rail 332 allows the blade housing 320 to move upward in the second direction with respect to the guide housing 310.

Specifically, the blade housing 320 may move from the lowermost point to the middle point within the entire track segment of the blade housing 320.

Figure 10A:
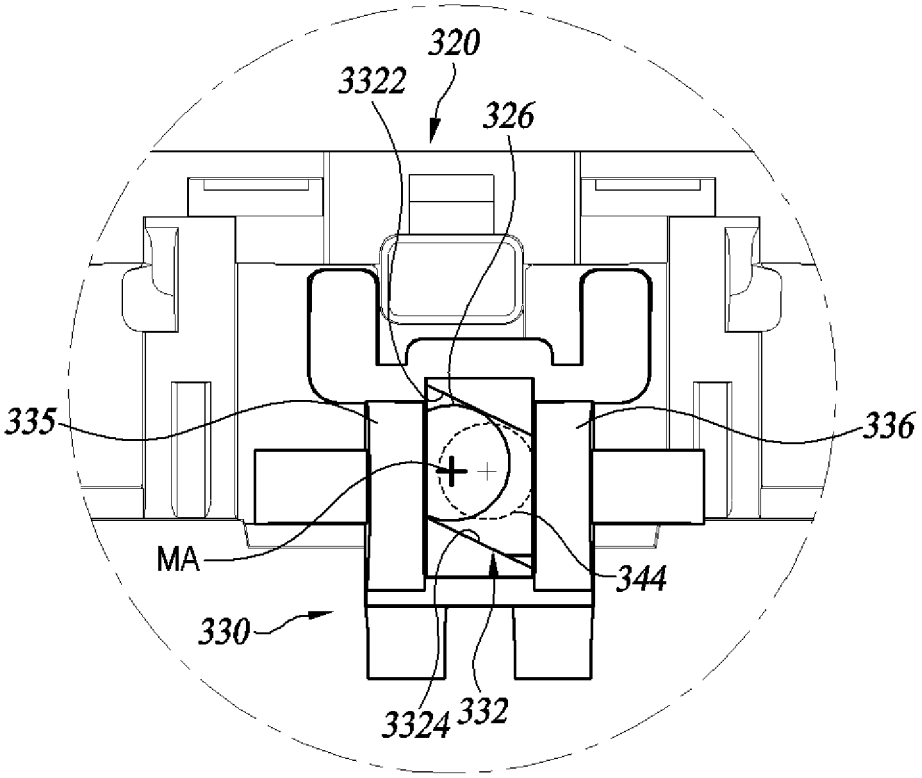
Figure 10B:
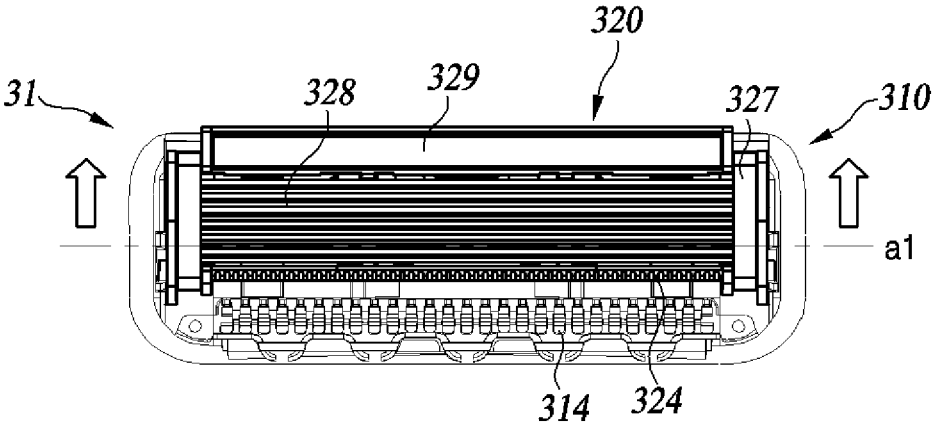

As shown in FIGS. 10A and 10B, the eccentric cam head 344 may be at the 3 o'clock position with respect to the rotation axis MA of the eccentric cam body 342.

The eccentric cam head 344 may contact the second side wall 336 of the drive receiving member 330 while moving from the 12 o'clock position to the 3 o'clock position, whereby depressing the second side wall 336.

With the movement of the drive receiving member 330 relative to the guide housing 310 limited to the first direction, depressing the second side wall 336 by the eccentric cam head 344 allows the drive receiving member 330 to move to the right in the first direction with respect to the guide housing 310.

In particular, the driving receiving unit 330 may move from the middle point to the rightmost point within the entire track segment of the driving receiving unit 330.

As the drive receiving member 330 moves to the right, the lower surface 3324 of the first direction-switching rail 332 may depress the first guide member 326.

Since the movement of the blade housing 320 relative to the guide housing 310 is limited to the second direction, depressing the first guide member 326 by the lower surface 3324 of the first direction-switching rail 332 allows the blade housing 320 to move upward in the second direction with respect to the guide housing 310.

Specifically, the blade housing 320 may move from the middle point to the uppermost point within the entire track segment of the blade housing 320.

With the razor assembly 30 according to at least one embodiment of the present disclosure, the linear motion of the blade housing 320 accelerates the speed of the shaving by the user, so that the cutting of the hair can become very fast.

In addition, the cutting surface of the hair is reduced by reducing the tugging caused by the at least one shaving blade 328 pulling the hair when shaving, thereby increasing the efficiency of the hair cutting by the at least one shaving blade 328.

As shown in FIGS. 7A to 10B, at least a portion of the first direction-switching rail 332 may include a straight region.

In particular, the first direction-switching rail 332 may have a diagonal shape with respect to the first direction, and the travel path of the first guide member 326 may have a diagonal path corresponding to the diagonal shape of the first direction-switching rail 332.

The slope of the straight region of the first direction-switching rail 332 may be 15 degrees to 30 degrees.

Here, the slope of the straight region refers to an angle formed by the extension line of the straight region and a straight line parallel to the first direction on a plane including the first direction-switching rail 332.

The razor assembly according to at least one embodiment of the present disclosure can adjust the degree of linear movement of the blade housing by changing the slope of the first direction-switching rail. A detailed description in this regard is presented with reference to FIGS. 13A and 13B.

In FIGS. 7A to 10B, the driving receiving unit 330 is illustrated as including a direction-switching rail, and the blade housing 320 as including a guide member, but the present disclosure is not limited thereto.

For example, the blade housing 320 may include a direction-switching rail, and the drive receiving member 330 may include a guide member. Detailed description in this regard is presented with reference to FIGS. 18A and 18B.

Figure 11A:
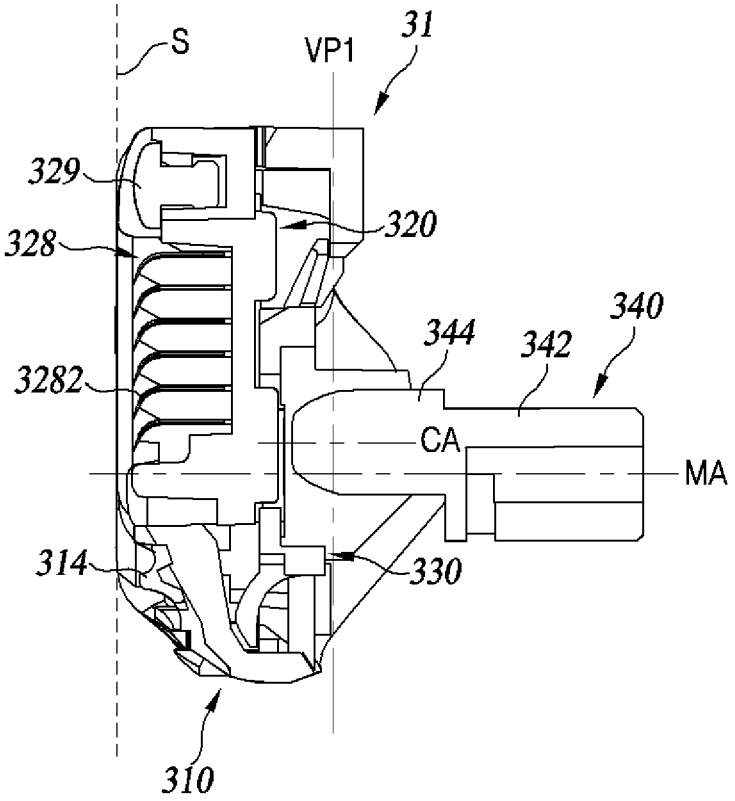
FIGS. 11A and 11B are diagrams of a razor assembly operating in a vertically pivoted state according to at least one embodiment of the present disclosure.
Figure 11B:
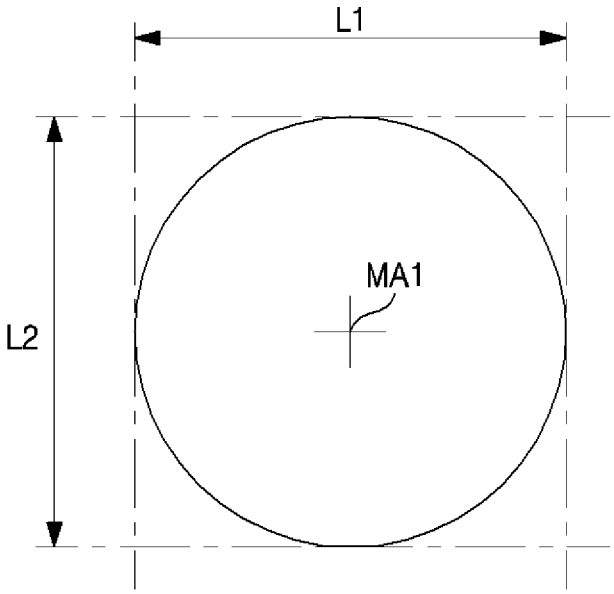

FIGS. 11A and 11B are diagrams of a razor assembly 30 operating in a vertically pivoted state according to at least one embodiment of the present disclosure.

Specifically, FIG. 11A shows the razor cartridge 31 in a vertically pivoted state, and FIG. 11B shows the movement profile of the eccentric cam head 344 in FIG. 11A. The movement profile of the eccentric cam head 344 is shown as projected on the shaving plane S in the direction perpendicular to the shaving plane S.

As shown in FIGS. 11A and 11B, the razor cartridge 31 may be pivoted such that the shaving plane S and the rotational axis MA of the eccentric cam body 342 are perpendicular to each other.

With the shaving plane S and the rotation axis MA of the eccentric cam body 342 being perpendicular to each other, the movement profile of the eccentric cam head 344 according to the rotation of the eccentric cam body 342 may be located on a plane VP1 that is parallel to the shaving plane S.

Thus, the movement profile of the eccentric cam head 344 projected onto the shaving plane S may be the same as that of the eccentric cam head 344 before being projected.

The movement profile of the eccentric cam head 344 projected onto the shaving plane S may have a diameter of L1 in the first direction and a diameter of L2 in the second direction.

Figure 12A:
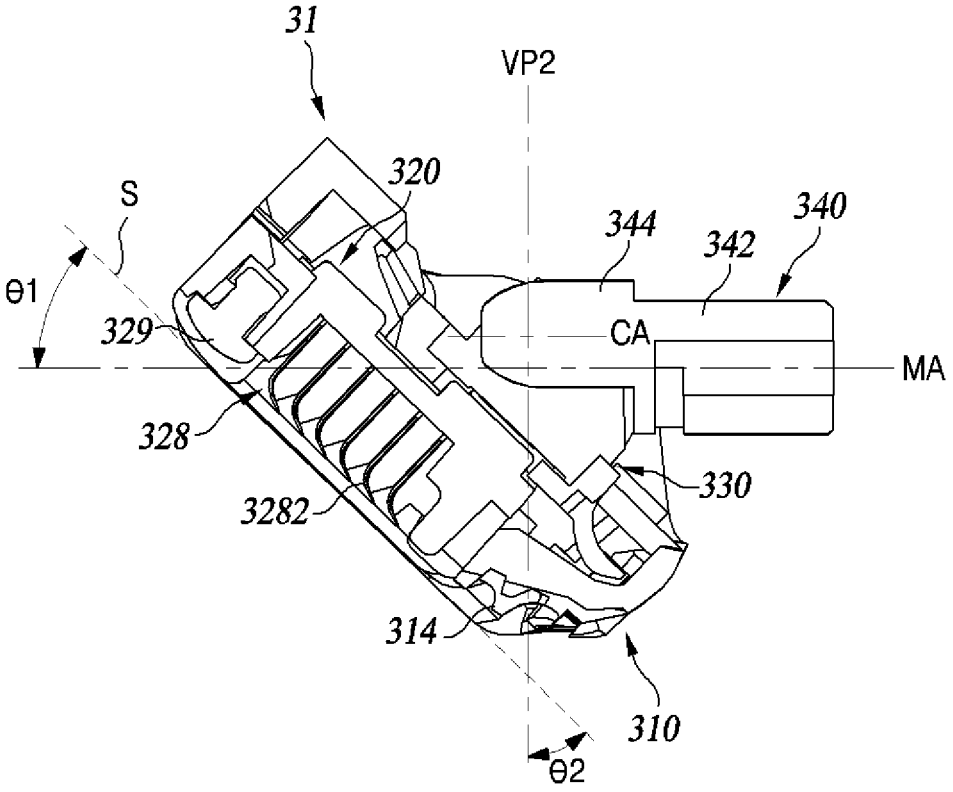
FIGS. 12A and 12B are diagrams of a razor assembly operating in a pivoted state at a first angle according to at least one embodiment of the present disclosure.
Figure 12B:
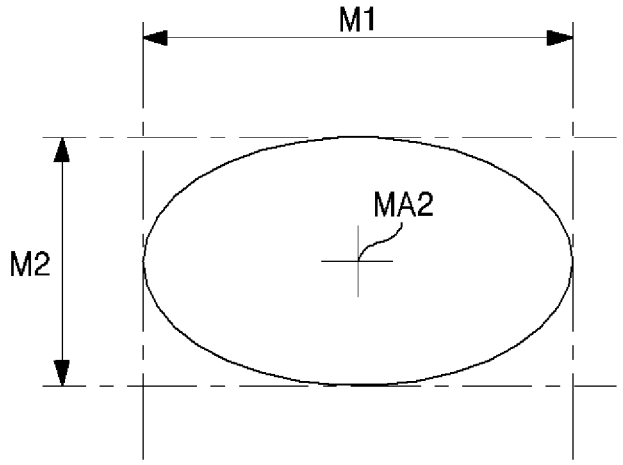

FIGS. 12A and 12B are diagrams of a razor assembly 30 operating in a pivoted state at a first angle θ1 according to at least one embodiment of the present disclosure.

Specifically, FIG. 12A shows the razor cartridge 31 pivoted by the first angle θ1, and FIG. 12B shows the movement profile of the eccentric cam head 344 in FIG. 12A. The movement profile of the eccentric cam head 344 is shown as projected on the shaving plane S in the direction perpendicular to the shaving plane S.

As shown in FIGS. 12A and 12B, the shaving plane S and the rotation axis MA of the eccentric cam body 342 may form first angle θ1.

With the shaving plane S and the eccentric cam body 342 forming first angle θ1, the moving profile of the eccentric cam head 344 according to the rotation of the eccentric cam body 342 may be positioned on a plane VP2 that forms a second angle θ2 with the shaving plane S. Here, second angle θ2 has a value obtained by subtracting first angle θ1 from 90 degrees.

In this case, the movement profile of the eccentric cam head 344 projected onto the shaving plane S may have the shape of an ellipse.

Specifically, the projected movement profile of the eccentric cam head 344 may have a second direction diameter M2 reduced compared to that before being projected, the value of which may be obtained by multiplying the second direction diameter M2 before projection by COS (θ2).

In contrast, the projected movement profile may have a projected first direction diameter M1 that is the same as before the projection as long as the pivot axis PA in the head portion 352 is parallel to the first direction.

Accordingly, the projected first direction diameter M1 in FIG. 12B may be the same as the projected first direction diameter L1 in FIG. 11B.

Here, the first direction diameter refers to a diameter formed along the first direction of all movement profiles of the eccentric cam head 344, and the second direction diameter refers to the diameter formed along the second direction.

The first-direction movement of the drive receiving member 330 may be made with the eccentric cam head 344 by depressing the first side wall 335 and the second side wall 336 which are spaced apart in the first direction.

Accordingly, the range of the first-direction movement of the drive receiving member 330 may be determined by the first direction diameter of the movement profile of the eccentric cam head 344 projected onto the shaving plane S.

When the drive receiving member 330 and the driving transmission unit 340 share the same movement profile, the range of the second-direction movement of the blade housing 320 may be determined according to the range of the first-direction movement of the drive receiving member 330.

Since the projected first direction diameter has a constant value regardless of the degree of pivoting of the razor cartridge 31, the range of the first-direction movement of the drive receiving member 330 also has a constant value regardless of the degree of pivoting of the razor cartridge 31.

Accordingly, the range of the second-direction movement of the blade housing 320 may also have a constant value, regardless of the degree of pivoting of the razor cartridge 31.

Thus, the blade housing 320 according to at least one embodiment of the present disclosure can reciprocate linearly to the same extent within the entire pivot segment of the razor cartridge 31, resulting in a more improved shaving experience by the user.

In addition, the razor assembly 30 according to at least one embodiment of the present disclosure is configured so that the razor cartridge 31 may pivot while permitting the movement of the eccentric cam head 344 without interference with the side walls 335 and 336 of the drive receiving member 330, and thereby the assembly tolerance can be easily controlled between the side walls 335 and 336 of the drive receiving member 330 and the eccentric cam head 344.

As a result, the razor assembly 30 according to at least one embodiment of the present disclosure has an effect of minimizing momentum loss and noise generation due to the linear movement of the blade housing 320.

Figure 13A:
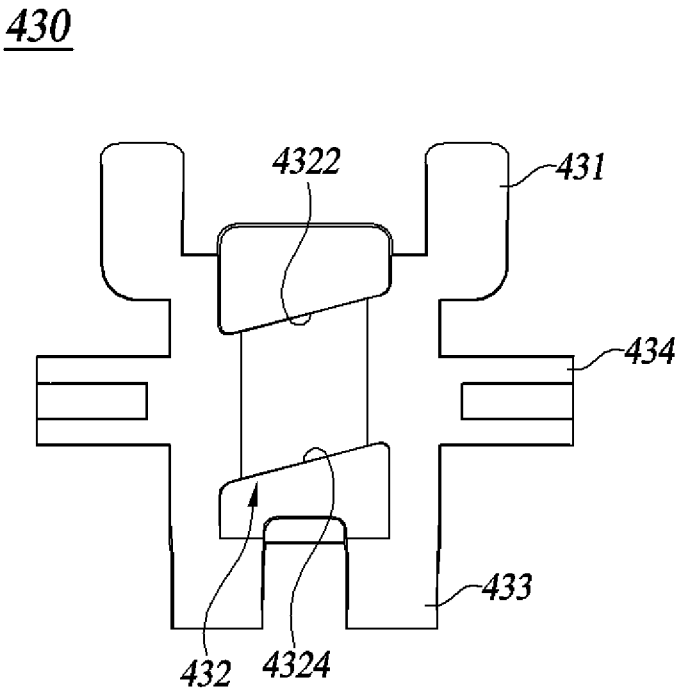
FIGS. 13A and 13B are diagrams of a drive receiving member according to another embodiment of the present disclosure.
Figure 13B:
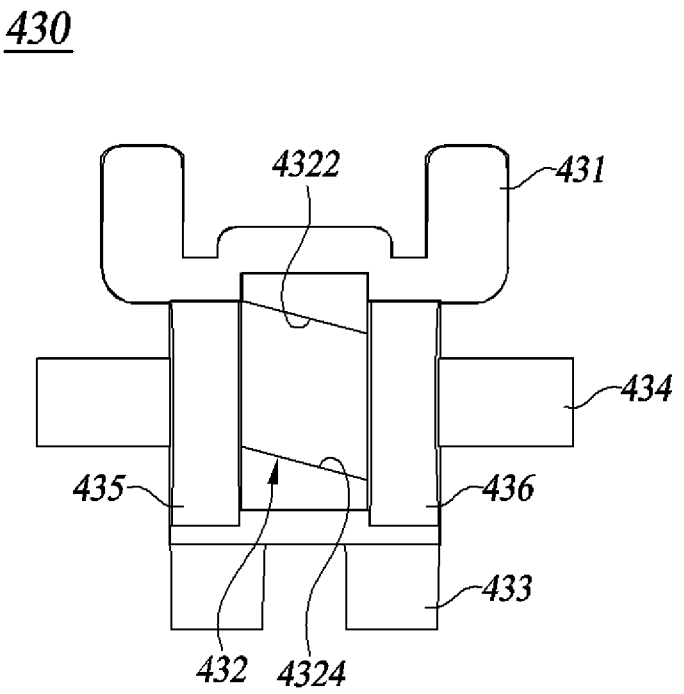

The drive receiving member according to another embodiment of the present disclosure shown in FIGS. 13A and 13B to be described has a gentler slope of the first direction-switching rail compared to the drive receiving member of the above mentioned embodiment of the present disclosure shown in FIGS. 3 to 12B. Hereinafter, a description will be given mainly of the distinctive features according to another embodiment of the present disclosure, and repetitive description of features substantially the same as the already mentioned embodiment will be omitted to avoid redundancy.

FIGS. 13A and 13B are diagrams of a drive receiving member 430 according to another embodiment of the present disclosure.

Specifically, FIGS. 13A and 13B illustrate front and rear views of the driving receiving unit 430 according to another embodiment of the present disclosure, respectively. FIGS. 13A and 13B show an upper protrusion 431, a lower protrusion 433, a stopping protrusion 434, a first side wall 435, and a second side wall 436 of the drive receiving member 430, and an upper surface 4322 and a lower surface 4324 of the first direction-switching rail 432.

As shown in FIGS. 7A to 10B, at least a portion of the first direction-switching rail 332 may include a region that is not parallel to the first direction.

For example, the first direction-switching rail 332 may have a diagonal shape with respect to the first direction, and the travel path of the first guide member 326 may have a diagonal path corresponding to the diagonal shape of the first direction-switching rail 332.

When the first direction-switching rail 332 has a diagonal shape, the range of the second-direction movement of the blade housing 320 may change depending on the degree of slope of the diagonal line formed by the first direction-switching rail 332.

For example, as the slope of the oblique line formed by the first direction-switching rail 332 becomes steeper, the range of the second-direction movement of the blade housing 320 may increase.

On the contrary, as the slope of the oblique line formed by the first direction-switching rail 332 becomes gentler, the range of the second-direction movement of the blade housing 320 may decrease.

As shown in FIGS. 13A and 13B, the first direction-switching rail 432 of the drive receiving member 430 according to another embodiment of the present disclosure has a gentler slope as compared with the previously mentioned embodiment of the present disclosure.

Accordingly, the range of the second-direction movement of the blade housing (not shown) according to another embodiment may be smaller than that of the previously mentioned embodiment.

Although FIGS. 13A and 13B illustrate that the first direction-switching rail 432 of the drive receiving member 430 according to another embodiment has a lower slope as compared to the previously mentioned embodiment, the present disclosure is not limited thereto.

For example, the first direction-switching rail 432 of the drive receiving member 430 according to another embodiment may have a higher slope as compared with the previously mentioned embodiment.

In this case, the range of the second-direction movement of the blade housing (not shown) according to another embodiment may be larger than in the previously mentioned embodiment.

The razor assembly according to the present disclosure can adjust the range of the second-direction movement of the blade housing by adjusting the magnitude of the slope of the first direction-switching rail, and thereby the degree of linear motion of the blade housing can be adjusted.

Unlike the drive receiving member of the previously mentioned embodiment shown in FIGS. 3 to 12B, the drive receiving member of yet another embodiment shown in FIGS. 14A to 17B has a plurality of regions having different slopes. Hereinafter, a description will be given mainly of distinctive features according to yet another embodiment of the present disclosure, and repetitive description of features substantially the same as the previously mentioned embodiment will be omitted to avoid redundancy.

Figure 14A:
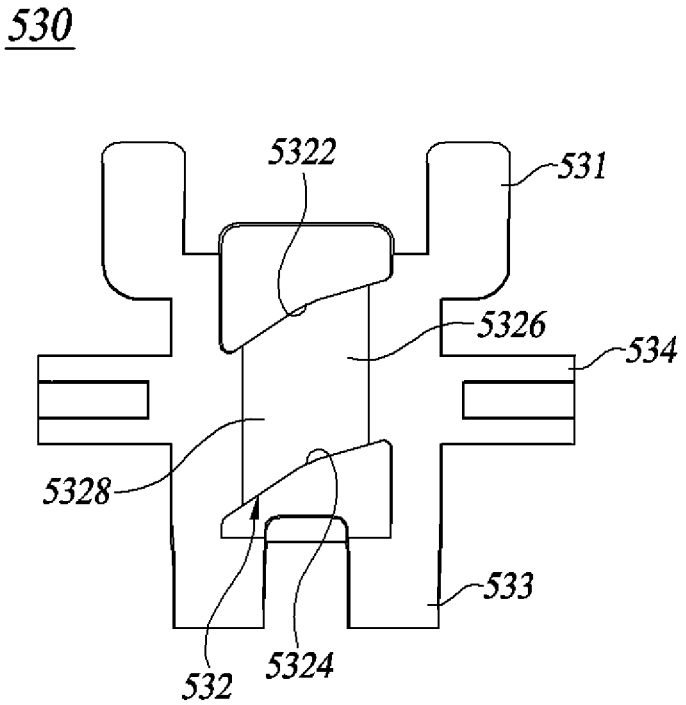
FIGS. 14A and 14B are diagrams of a drive receiving member according to yet another embodiment of the present disclosure.
Figure 14B:
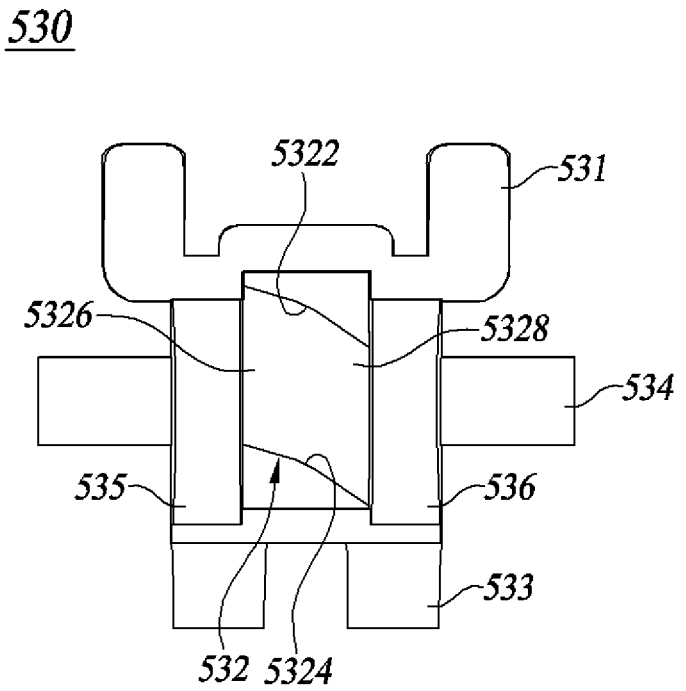

FIGS. 14A and 14B are diagrams of a drive receiving member 530 according to yet another embodiment of the present disclosure.

Specifically, FIGS. 14A and 14B are front and rear views of the drive receiving member 530 according to yet another embodiment, respectively. FIGS. 14A and 14B show an upper protrusion 531, a lower protrusion 533, a stopping protrusion 534 of the drive receiving member 530.

As shown in FIGS. 14A and 14B, the drive receiving member 530 may have a first direction-switching rail 532 which includes two straight regions.

Specifically, the first direction-switching rail 532 may include a first region 5326 having a first slope and a second region 5328 having a second slope greater than the first slope.

The second region 5328 may be located below the first region 5326 on the first direction-switching rail 532.

In order to allow a smooth movement of a first guide member 526 (refer to FIG. 6 at 326), the boundary region between the first region 5326 and the second region 5328 may be rounded.

Figure 15A:
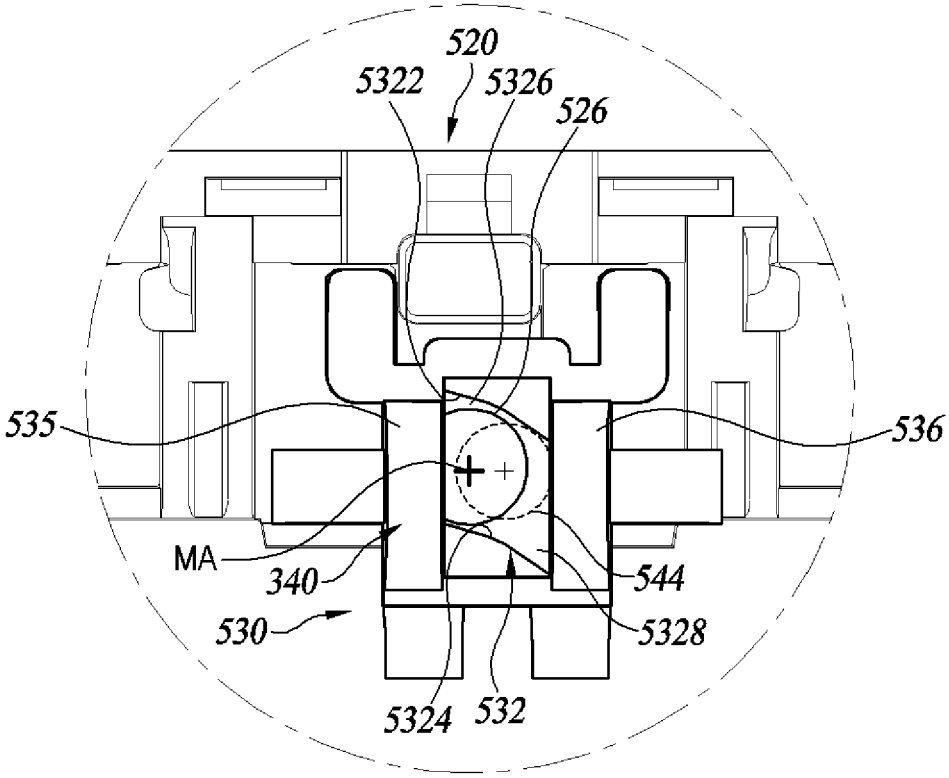
FIGS. 15A, 16A and 17A are rear views
Figure 15B:
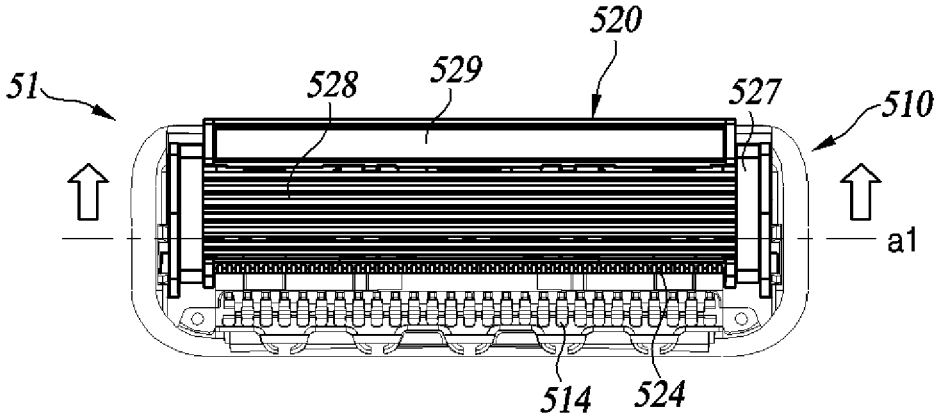
FIGS. 15B, 16B and 17B are front views illustrating sequential steps of operation of a razor assembly according to yet another embodiment of the present disclosure.
Figure 16A:
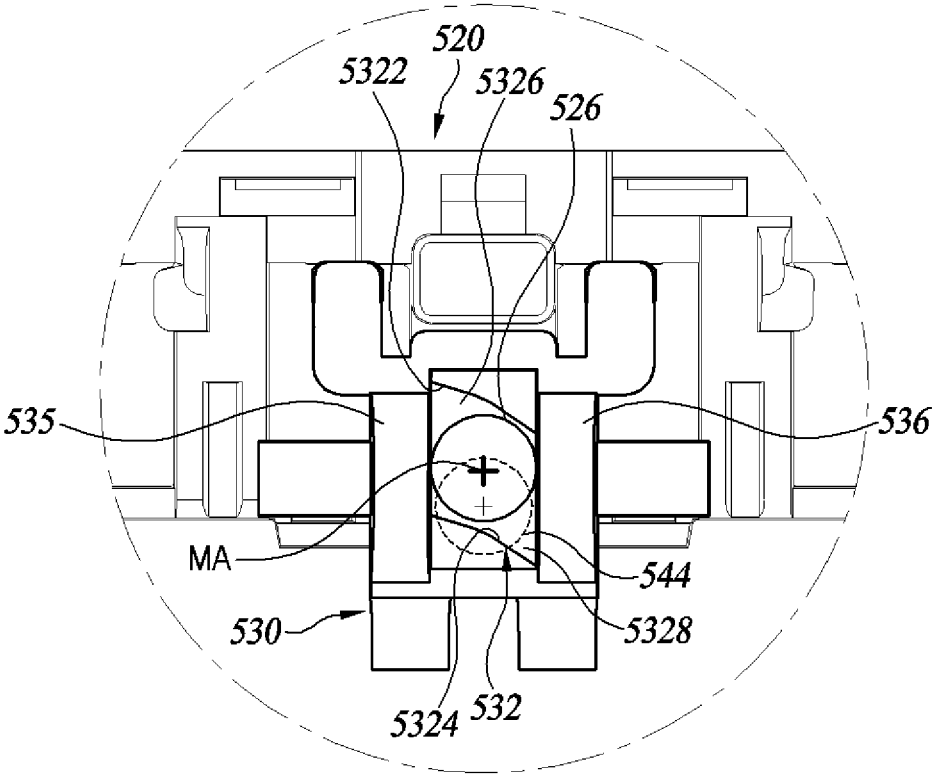
Figure 16B:
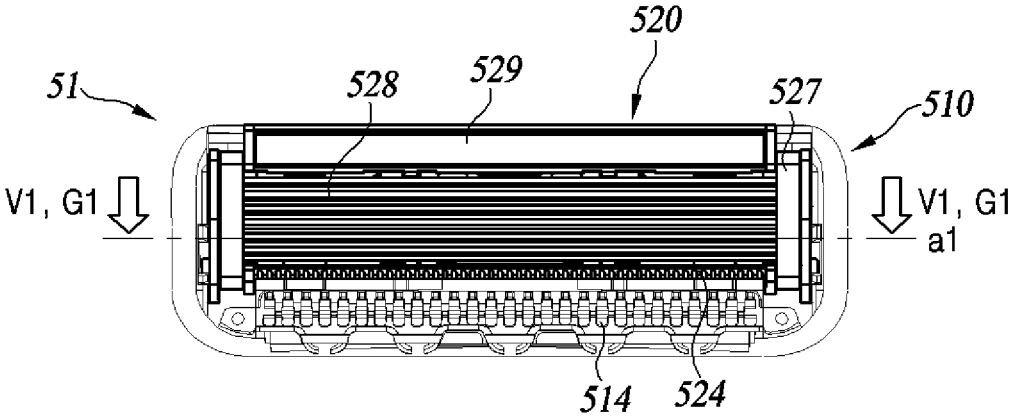
Figure 17A:
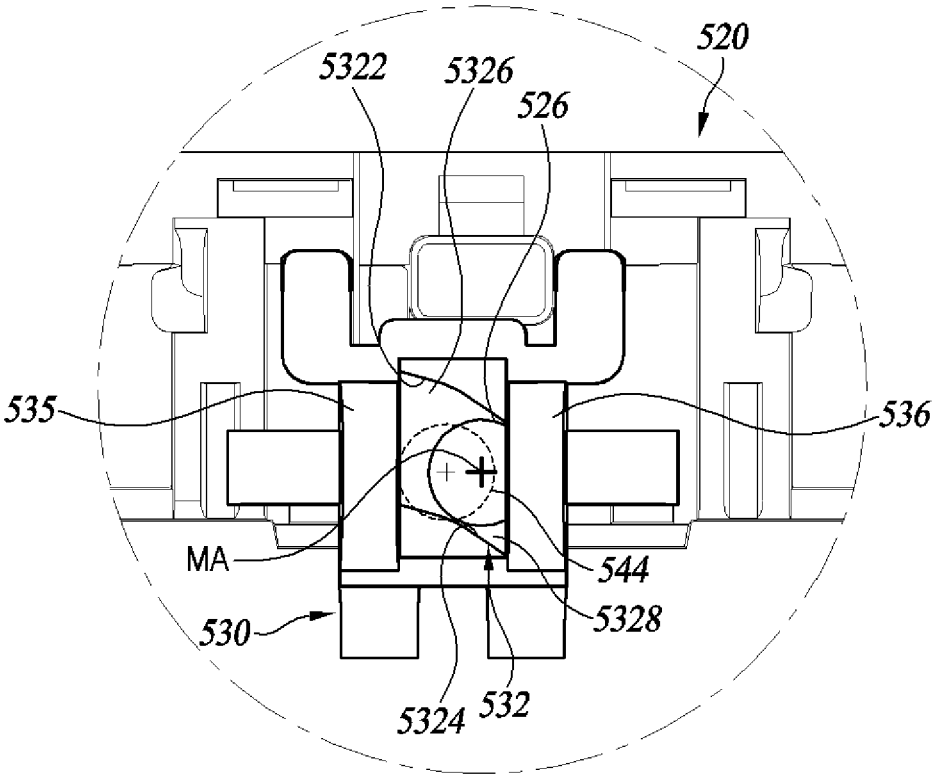
Figure 17B:
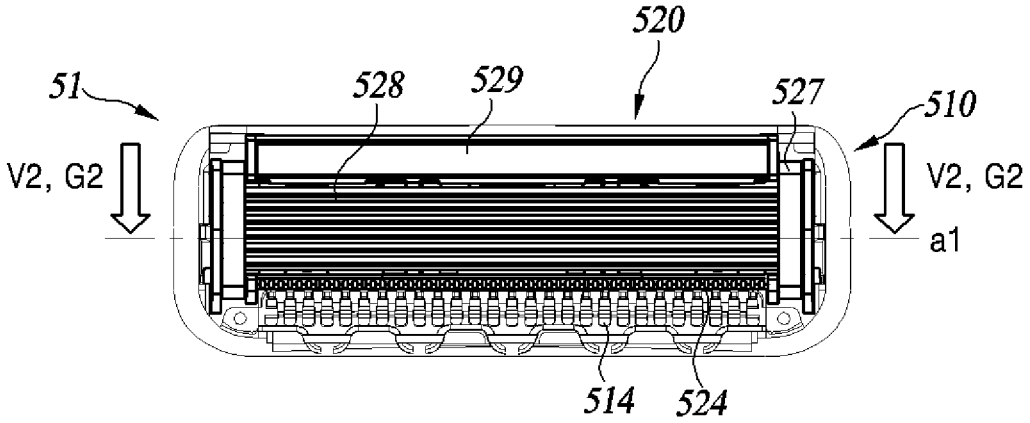

FIGS. 15A, 16A and 17A are rear views and FIGS. 15B, 16B and 17B are front views illustrating sequential steps of operation of a razor assembly according to yet another embodiment of the present disclosure.

Specifically, FIGS. 15A to 17B illustrate an eccentric cam head 544 (refer also to FIG. 6 at 344) when it is at the 3 o'clock, 6 o'clock, and 9 o'clock positions with respect to rotation axis MA of an eccentric cam body 542 (342 in FIG. 6), respectively.

In FIGS. 15A to 17B, the eccentric cam body 542 is assumed to rotate clockwise about the rotation axis MA when the razor cartridge is viewed from the rear side.

In FIGS. 15A to 17B, it is assumed that the razor cartridge is pivoted such that the shaving plane S and the rotational axis MA of the eccentric cam body 52 are perpendicular to each other.

FIGS. 15A, 16A and 17A show a blade housing 520 and a drive receiving member 530 as viewed from the rear of the razor cartridge. FIGS. 15B, 16B and 17B show a guide housing 510 and the blade housing 520 as viewed from the front of the razor cartridge. FIGS. 15B, 16B and 17B show a razor cartridge 51 including a guard member 514, a comb unit 524, a clip 527, at least one shaving blade 528, and a lubricating strip 529

As shown in FIGS. 15A and 15B, the eccentric cam head 544 may be at the 3 o'clock position with respect to the rotation axis MA of the eccentric cam body 542.

The eccentric cam head 544 may contact the drive receiving member 530 by its second side wall 536 while moving from the 12 o'clock position to the 3 o'clock position, whereby depressing the second side wall 536.

Since the movement of the drive receiving member 530 with respect to the guide housing 510 is limited to the first direction, when the eccentric cam head 544 depresses the second side wall 536, the drive receiving member 530 may move to the right in the first direction with respect to the guide housing 510.

In particular, the driving receiving unit 530 may move from a middle point to a rightmost point within the entire track segment of the driving receiving unit 530.

As the drive receiving member 530 moves to the right, a lower surface 5324 of the first direction-switching rail 532 may depress the first guide member 526.

Since the movement of the blade housing 520 relative to the guide housing 510 is limited to the second direction, depressing the first guide member 526 by the lower surface 5324 of the first direction-switching rail 532 allows the blade housing 520 to move upward in the second direction with respect to the guide housing 510.

In particular, the blade housing 520 may move from a middle point to an uppermost point within the entire track segment of the blade housing 520.

As shown in FIGS. 16A and 16B, the eccentric cam head 544 may be at the 6 o'clock position with respect to the rotation axis MA of the eccentric cam body 542.

The eccentric cam head 544 may contact the drive receiving member 530 by its first side wall 535 while moving from the 3 o'clock position to the 6 o'clock position, whereby depressing the first side wall 535.

Since the movement of the drive receiving member 530 with respect to the guide housing 510 is limited to the first direction, when the eccentric cam head 544 depresses the first side wall 535, the drive receiving member 530 may move to the left in the first direction with respect to the guide housing 510.

In particular, the driving receiving unit 530 may move from the rightmost point to the middle point within the entire track segment of the driving receiving unit 530.

The first guide member 526, during the movement from the 3 o'clock position to the 6 o'clock position, may be located in the first region 5326 on the first direction-switching rail 532.

As the drive receiving member 530 moves to the left side, an upper surface 5322 of the first region 5326 may depress the first guide member 526.

Since the movement of the blade housing 520 relative to the guide housing 510 is limited to the second direction, depressing the first guide member 526 by the upper surface 5322 of the first direction-switching rail 532 allows the blade housing 520 to move downward in the second direction with respect to the guide housing 510.

In particular, the blade housing 520 may move from the uppermost point to the middle point within the entire track segment of the blade housing 520.

In this case, the blade housing 520 may move by a first distance G1 at a first mean velocity V1.

Here, the first mean velocity V1 refers to a value obtained by dividing the first distance G1 by the time required for the blade housing 520 to reach the middle point from the uppermost point.

As shown in FIGS. 17A and 17B, the eccentric cam head 544 may be at the 9 o'clock position with respect to the rotation axis MA of the eccentric cam body 542.

The eccentric cam head 544 may contact the first side wall 535 of the drive receiving member 530 while moving from the 6 o'clock position to the 9 o'clock position, whereby, depressing the first side wall 535.

Since the movement of the drive receiving member 530 with respect to the guide housing 510 is limited to the first direction, depressing the first side wall 535 by the eccentric cam head 544 allows the drive receiving member 530 to move to the left in the first direction with respect to the guide housing 510.

In particular, the driving receiving unit 530 may move from the middle point to the leftmost point within the entire track segment of the driving receiving unit 530.

The first guide member 526, during the movement from the 6 o'clock position to the 9 o'clock position, may be located in the second region 5328 on the first direction-switching rail 532.

As the drive receiving member 530 moves to the left side, the upper surface 5322 of the first region 5326 may depress the first guide member 526.

Since the movement of the blade housing 520 relative to the guide housing 510 is limited to the second direction, depressing the first guide member 526 by the upper surface 5322 of the first direction-switching rail 532 allows the blade housing 520 to move downward in the second direction with respect to the guide housing 510.

Specifically, the blade housing 520 may move from the middle point to the lowermost point within the entire track segment of the blade housing 520.

In this case, the blade housing 520 may move by a second distance G2 at a second mean velocity V2.

Here, the second mean velocity V2 refers to a value obtained by dividing the second distance G2 by the time required for the blade housing 520 to reach the lowermost point from the middle point.

When the blade housing 520 linearly moves downward in the second direction, the segment that substantially contributes to hair cutting of the shaving blade (not shown) may be the latter half of the entire track segment of the blade housing 320, which extends from the middle point to the lowermost point thereof.

Movement of the blade housing 520 over this segment may be made when the first guide member 526 passes the second region 5328 of the first direction-switching rail 532.

When the first region 5326 has the same length in the first direction as the second region 5328, the second slope of the second region 5328 has a value greater than the first slope of the first region 5326, and therefore the second mean velocity V2 and the second distance G2 may be greater than the first mean velocity V1 and the first distance G1, respectively.

Thus, in the latter half segment of the downward movement of the blade housing 520, the shaving blade (not shown) can move faster and farther than the first half segment, resulting in more effective hair-cutting.

In yet another embodiment of the present disclosure shown in FIGS. 18A and 18B to be described later, unlike the previously mentioned embodiment shown in FIGS. 3 to 12B, the blade housing includes a direction-switching rail and the drive receiving member includes a guide member. Hereinafter, a description will be given mainly of distinctive features according to yet another embodiment, and repetitive description of features substantially the same as the previously mentioned embodiment will be omitted to avoid redundancy.

Figure 18A:
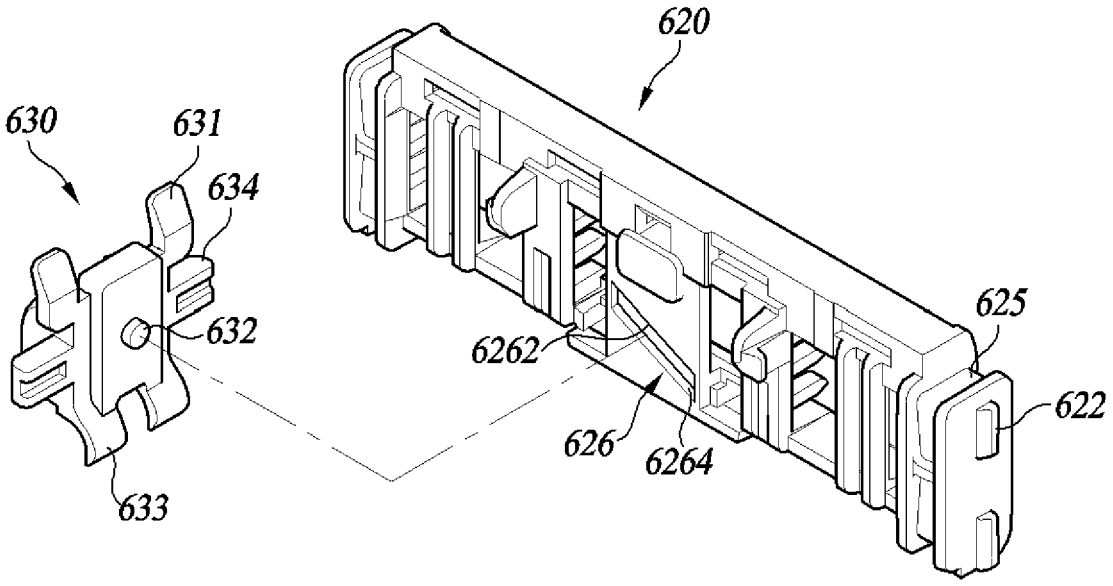
FIGS. 18A and 18B are diagrams of a blade housing and a drive receiving member according to yet another embodiment of the present disclosure.
Figure 18B:
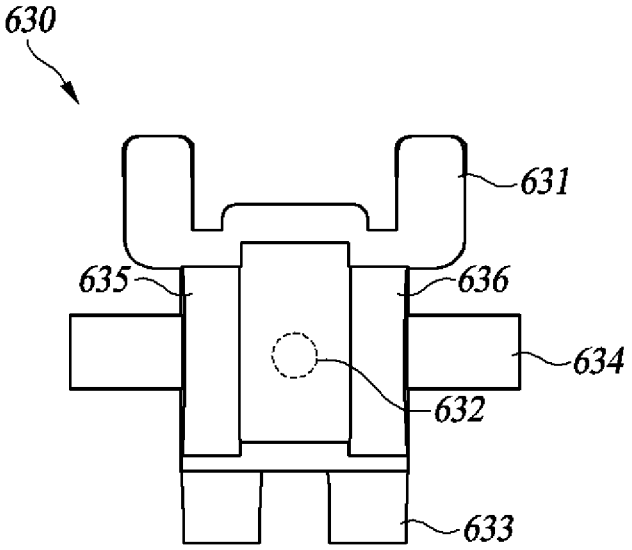

FIGS. 18A and 18B are diagrams of a blade housing 620 and a drive receiving member 630 according to yet another embodiment of the present disclosure.

Specifically, FIG. 18A illustrates the drive receiving member 630 when separated from the blade housing 620. FIG. 18B illustrates a rear view of the drive receiving member 630.

As shown in FIGS. 18A and 18B, the blade housing 620 includes side protrusions 622, a clip receiving groove 625, and a second direction-switching rail 626, and the drive receiving member 630 includes an upper protrusion 631, a second guided member 632, a lower protrusion 633, and a stopping protrusion 634.

The second guided member 632 may be inserted into the second direction-switching rail 626 and configured to move along the second direction-switching rail 626.

At least a portion of the second direction-switching rail 626 may include a region that is not parallel to the first direction.

The drive receiving member 630 may have a first side wall 635 and a second side wall 636, either of which is contacted by an eccentric cam head (not shown), whereby depressing the first side wall 635 or the second side wall 636.

The movement of the drive receiving member 630 with respect to a guide housing (not shown) is limited to the first direction, and depressing the first side wall 635 or the second side wall 636 by the eccentric cam head allows the drive receiving member 630 to move in the first direction with respect to the guide housing 610.

As the drive receiving member 630 moves in the first direction, the second guide member 632 may depress the second direction-switching rail 626 by its upper side 6262 or lower side 6264.

Since the movement of the blade housing 620 with respect to the guide housing 610 is limited to the second direction, depressing the upper side 6262 or the lower side 6264 of the second direction-switching rail 626 by the second guide member 632 allows the blade housing 620 to move in the second direction with respect to the guide housing 610.

With the razor assembly according to yet another embodiment of the present disclosure, the speed of the user's shaving by hand is accelerated by the linear motion of the blade housing 620, thereby enabling a very speedy performance of hair cutting.

In addition, the cutting surface of the hair is reduced by reducing the tugging caused by the shaving blade pulling the hair when cutting, thereby increasing the efficiency of hair-cutting by the shaving blade.

As described above, according to at least one embodiment of the present disclosure, the razor assembly has an effect of providing an improved shave to the user by maintaining a constant degree of linear movement of the blade housing during shaving.

Although exemplary embodiments of the present disclosure have been described for illustrative purposes, those skilled in the art will appreciate that various modifications, additions and substitutions are possible, without departing from the characteristics of the embodiments of the present disclosure. Therefore, exemplary embodiments of the present disclosure have been described for the sake of brevity and clarity. The scope of the technical idea of the present embodiments is not limited by the illustrations. Accordingly, one of ordinary skill would understand the scope of the claimed invention is not to be limited by the above explicitly described embodiments but by the claims and equivalents thereof.

What is claimed is:

1. A razor assembly, comprising:

a guide housing;

a converter disposed on one side of the guide housing and configured to be movable in a first direction with respect to the guide housing;

a blade housing disposed on another side of the guide housing;

at least one shaving blade having a cutting edge and disposed at the blade housing;

a razor handle extending from the guide housing;

a rotating shaft assembly configured to transmit a driving force to the converter, at least a portion of the rotating shaft assembly disposed on one side of the razor handle; and a guard disposed in front of or below the at least one shaving blade in a shaving direction so as to define a shaving plane by contacting skin, wherein the blade housing is configured to be moved with respect to the guide housing in a second direction that is not parallel to the first direction in response to movement of the converter in the first direction, wherein the converter is further configured to be moved in the first direction with respect to the guide housing by the driving force transmitted from the rotating shaft assembly, and wherein the one side and the another side of the guide housing are positioned on opposite sides of the guide housing in a direction perpendicular to the shaving plane.

2. The razor assembly of claim 1, wherein the second direction is parallel to the shaving direction of the at least one shaving blade.

3. The razor assembly of claim 1, wherein the converter comprises:

a first side wall and a second side wall aligned along the first direction and disposed to face each other, wherein the rotating shaft assembly comprises an eccentric cam body configured to be rotatable about a rotation axis, and an eccentric cam head extending from the eccentric cam body along a central axis spaced apart from the rotation axis, the eccentric cam head positioned between the first side wall and the second side wall, and wherein the converter is further configured to be moved in the first direction with respect to the guide housing based on the eccentric cam head contacting the first side wall or the second side wall.

4. The razor assembly of claim 3, wherein:

one of the converter or the blade housing includes a direction-switching rail;

another one of the converter or the blade housing, which does not include the direction-switching rail, includes a guided member that is movable along the direction-switching rail; and at least a portion of the direction-switching rail comprises a region that is not parallel to the first direction.

5. The razor assembly of claim 4, wherein the guide housing is configured to pivot with respect to the razor handle about a pivot axis that is parallel to the first direction.

6. The razor assembly of claim 5, wherein the pivot axis passes through the eccentric cam head.

7. The razor assembly of claim 6, wherein at least a portion of the direction-switching rail comprises a straight region.

8. The razor assembly of claim 7, wherein:

the straight region has a slope that is between 15 and 30 degrees; and the slope of the straight region is an angle formed by an extension line of the straight region and a straight line parallel to the first direction on a plane including the direction-switching rail.

9. The razor assembly of claim 4, wherein:

the direction-switching rail comprises a first region having a first slope with respect to a straight line parallel to the first direction and a second region having a second slope with respect to the straight line parallel to the first direction; and the second slope is greater than the first slope.

10. The razor assembly of claim 9, wherein the second region is located below the first region on the direction-switching rail.

* * * * *